United States Patent [19]

Ames et al.

[11] Patent Number: 4,501,316

[45] Date of Patent: Feb. 26, 1985

[54] METHOD OF CASTING AMORPHOUS METALS

[75] Inventors: S. Leslie Ames, Sarver; Thomas H. Gray, Pittsburgh; Lewis L. Kish, Sarver, all of Pa.

[73] Assignee: Allegheny Ludlum Steel Corporation, Pittsburgh, Pa.

[21] Appl. No.: 528,289

[22] Filed: Aug. 31, 1983

Related U.S. Application Data

[62] Division of Ser. No. 382,823, May 27, 1982, Pat. No. 4,450,206.

[51] Int. Cl.[3] ..... B22D 11/06

[52] U.S. Cl. ..... 164/463

[58] Field of Search ..... 164/463, 423

[56] References Cited

U.S. PATENT DOCUMENTS 4,236,946 12/1980 Aboaf et al. ..... 148/403

FOREIGN PATENT DOCUMENTS 56-257 1/1981 Japan ..... 148/31.55

*Primary Examiner*—Kuang Y. Lin

*Attorney, Agent, or Firm*—Patrick J. Viccaro

[57] ABSTRACT

An amorphous Fe-B-Si alloy and article made therefrom is provided having improved castability while maintaining good magnetic properties, ductility and improved thermal stability. Fe-B-Si alloys containing 0.1–4.0% Cr, in atomic percent, have improved castability and amorphousness. An alloy is provided generally consisting essentially of 6–10% B, 14–17% Si, 0.1–4.0% Cr, and the balance iron, and no more than incidental impurities. A method of casting an amorphous strip material from the alloy is also provided.

2 Claims, 7 Drawing Figures

DC AND 200, 1000 HZ A.C. CURVES FOR $Fe_{75}Cr_1B_{8.5}Si_{15.5}$ ALLOY

AL4750 6MIL RINGS

FE-CR-B-Si AMORPHOUS ALLOY

CORE LOSS AND APPARENT CORE LOSS
VS. INDUCTION AT 60Hz

METHOD OF CASTING AMORPHOUS METALS

This is a division of application Ser. No. 382,823 filed May 27, 1982 now U.S. Pat. No. 4,450,206.

BACKGROUND OF THE INVENTION

This invention relates to amorphous metal alloys. Particularly, the invention relates to iron-boron-silicon amorphous metals and articles made thereof having improved magnetic properties and physical properties.

Amorphous metals may be made by rapidly solidifying alloys from their molten state to a solid state. Various methods known in rapid solidification technology include spin casting and draw casting, among others. Vapor and electrodeposition can also be used to make amorphous metals. Amorphous metals provided by any of the above methods have distinctive properties associated with their non-crystalline structure. Such materials have been known, for example, to provide improved mechanical, electrical, magnetic and acoustical properties over counterpart metal alloys having crystalline structure. Generally, the amorphous nature of the metal alloy can be determined by metallographic techniques or by X-ray diffraction. As used herein, an alloy is considered "amorphous" if the alloy is substantially amorphous, being at least 75% amorphous. Best properties are obtained by having a (200) X-ray diffraction peak of less than one inch above the X-ray background level. This peak, in the case of body centered cubic ferrite (the hypoeutectic crystalline solid solution), occurs at a diffraction angle of 106° when using $Cr_{K\alpha}$ radiation.

Unless otherwise noted, all composition percentages recited herein are atomic percentages.

There are various known alloy compositions of Fe-B-Si. For example, U.S. Pat. No. 3,856,513, Chen et al, discloses an alloy and sheets, ribbons and powders made therefrom under the general formula $M_{60-90}Y_{10-30}Z_{0.1-15}$ where M is iron, nickel, chromium, cobalt, vanadium or mixtures thereof, Y is phosphorus, carbon, boron, or mixtures thereof and Z is aluminum, silicon, tin, antimony, germanium, indium, beryllium and mixtures thereof which can be made substantially amorphous. There are also known alloy compositions of Fe-B-Si which have shown promising magnetic properties and other properties for superior performance in electrical apparatus such as motors and transformers. U.S. Pat. No. 4,219,355, Luborsky, discloses an iron-boron-silicon alloy with crystallization temperature (the temperature at which the amorphous metal reverts to its crystalline state) of at least 608° F. (320° C.), a coercivity of less than 0.03 oersteds, and a saturation magnetization of at least 174 emu/g (approximately 17,000 G). Generally, the alloy contains 80 or more atomic percent iron, 10 or more atomic percent boron and no more than about 6 atomic percent silicon. An amorphous metal alloy strip, greater than 1-inch (2.54 cm) wide and less than 0.003-inch (0.00762 cm) thick, having specific magnetic properties, and made of an alloy consisting essentially of 77–80% iron, 12–16% boron and 5–10% silicon, all atomic percentages, is disclosed in U.S. patent application Ser. No. 235,064, by the common Assignee of the present application.

Attempts have been made to modify such amorphous materials by additions of other elements to optimize the alloy compositions for electrical applications. U.S. Pat. No. 4,217,135, DeCristofaro, discloses an iron-boron-silicon alloy having 1.5 to 2.5 atomic percent carbon to enhance the magnetic properties. U.S. Pat. No. 4,190,438, Aso et al, discloses an iron-boron-silicon magnetic alloy containing 2–20 atomic percent ruthenium.

An article entitled "Magnetic Properties of Amorphous Fe-Cr-Si-B Alloys" by K. Inomata et al, IEEE Transactions on Magnetics, Vol. Mag.-17, No. 6, November 1981, discloses substitution of Fe with Cr in high boron, low silicon amorphous alloys. There it is reported that Cr greatly decreases the Curie temperature, slightly increases crystallization temperature, decreases coercive force and magnetic core loss and increases initial magnetic permeability.

Chromium in amorphous alloys is also known for other reasons. U.S. Pat. No. 3,986,867, Matsumoto et al, relates to iron-chromium completely amorphous alloys having 1–40% Cr and 7–35% of at least one element of boron, carbon and phosphorus for improving mechanical properties, heat resistance and corrosion resistance. U.S. Pat. No. 4,052,201, Polk et al, discloses amorphous iron alloys containing 5–20% chromium for the purpose of improving resistance to embrittlement of the alloy.

While such known alloy compositions may have provided relatively good magnetic properties, they are not without drawbacks. All of the above alloys are costly because of the relatively large amount of boron. A lower boron version is highly desirable. Also, higher crystallization temperatures are desirable in order that the alloy will have less tendency to revert back to the crystalline state. The composition should be close to a eutectic composition so as to facilitate casting into the amorphous condition. Furthermore, the eutectic temperature should be as low as possible for purposes of improving castability. It is also desirable that the magnetic saturation should be high, on the order of at least 13,500 G. An object of this invention is to provide such an alloy which can compete with known conventional commercial nickel-iron alloys such as Al 4750 which nominally comprises 48% Ni-52% Fe, by weight percentage.

Furthermore, puddle turbulence of the molten metal during the casting of amorphous metal strip is a chronic problem with "melt-drag" or draw casting techniques and can lead to surface defects and decreased quench rate. Examples of draw casting techniques are described in U.S. Pat. No. 3,522,836, issued Aug. 4, 1970, and U.S. Pat. No. 4,142,571, issued Mar. 6, 1979. An addition to the metal alloy which will reduce such turbulence is highly desirable.

SUMMARY OF THE INVENTION

In accordance with the present invention, an amorphous alloy and article are provided which overcome those problems of the known iron-boron-silicon amorphous metals. An amorphous metal alloy is provided consisting essentially of 6–10% boron, 14–17% silicon and 0.1–4.0% chromium, by atomic percentages, no more than incidental impurities and the balance iron. The chromium improves the fluidity characteristics and amorphousness of the alloy and was found to unexpectedly improve the molten metal puddle control during casting and hence the castability of the alloy.

An article made from the amorphous metal alloy of the present invention is provided, being at least singularly ductile (as herein defined) and having a core loss competitive with commercial Ni-Fe alloys, such as AL 4750, and particularly a core loss of less than 0.163 watts per pound (WPP) at 12.6 kilogauss (1.26 tesla) at 60

Hertz. The article of the alloy has a saturation magnetization measured at 75 oersteds ($B_{75H}$) of at least 13.5 kilogauss (1.35 tesla) and a coercive force ($H_c$) of less than 0.045 oersteds and may be in the form of a thin strip or ribbon material product. The alloy and resulting product have improved thermal stability characterized by a crystallization temperature of not less than 914° F. (490° C.).

DESCRIPTION OF THE PREFERRED EMBODIMENTS

Figure 1:
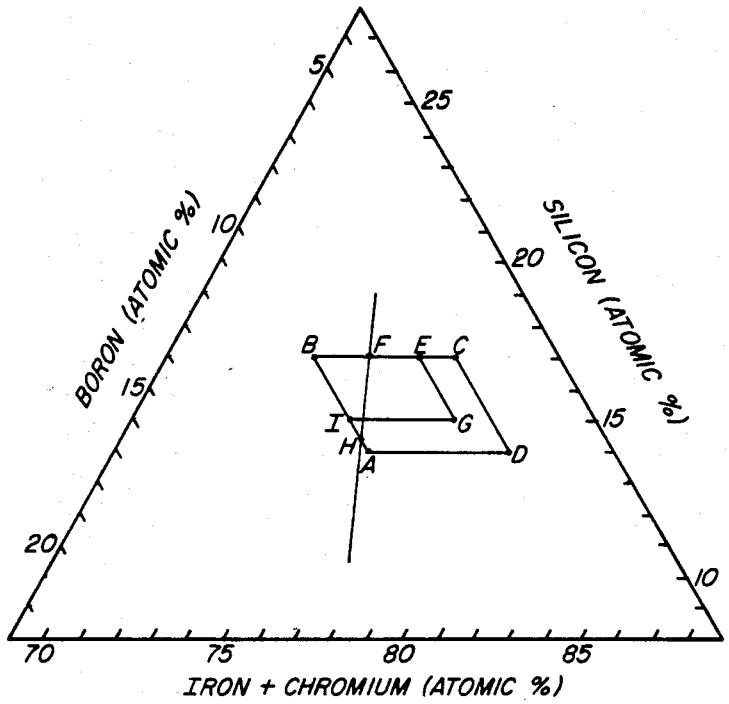
FIG. 1 is a ternary diagram which shows the composition ranges of the present invention with Cr grouped with Fe, and shows the eutectic line.

Generally, an amorphous alloy of the present invention consists essentially of 6–10% boron, 14–17% silicon and 0.1–4.0% chromium, and the balance iron. In FIG. 1, the compositions lying inside the lettered area defining the relationships expressed by points A, B, C and D are within the broad range of this invention, wherein chromium is constrained from 0.1 to 4.0%. The points B, E, G and I express relationships for compositions which lie within a preferred range of this invention wherein chromium is restricted to from 0.5 to 3.0%. The line between points F and H crossing through and extending outside the composition area relationships herein defined, represents the locus of eutectic points (lowest melting temperatures) for the eutectic valley in this region of interest for the case when chromium is near zero % in the Fe-B-Si ternary diagram.

The alloy of the present invention is rich in iron. The iron contributes to the overall magnetic saturation of the alloy. Generally, the iron content makes up the balance of the alloy constituents. The iron may range from about 73–80% and perferably about 73–78%, however, the actual amount is somewhat dependent upon the amount of other constituents in the alloy of the present invention.

The preferred composition ranges of the invention are shown in FIG. 1, along with the eutectic line or trough. All alloys of the present invention are close enough to the eutectic trough to be substantially amorphous as cast. The boron content is critical to the amorphousness of the alloy. The higher the boron content, the greater the tendency for the alloy to be amorphous. Also the thermal stability is improved. However, as boron increases, the alloys become more costly. The boron content may range from 6–10%, preferably 6 to less than 10% and, more preferably, 7 to less than 10%, by atomic percentages. Lower cost alloys of less than 7% boron are included in the invention, but are more difficult to cast with good amorphous quality.

Silicon in the alloy primarily affects the thermal stability of the alloy to at least the same extent as boron and in a small degree affects the amorphousness. Silicon has much less effect on the amorphousness of the alloy than does boron and may range from 14 to 17%, preferably from more than 15% to 17%.

The alloy composition of the present invention is considered to provide an optimization of the requisite properties of the Fe-B-Si alloys for electrical applications at reduced cost. Certain properties have to be sacrificed at the expense of obtaining other properties, but the composition of the present invention is found to be an ideal balance between these properties. It has been found that the iron content does not have to exceed 80% to attain the requisite magnetic saturation. By keeping the iron content below 80%, the other major constituent, namely boron and silicon, can be provided in varied amounts. To obtain an article made of the alloy of the present invention having increased thermal stability, the silicon amount is maximized. Greater amounts of silicon raise the crystallization temperature permitting the strip material to be heat treated at higher temperatures without causing crystallization. Being able to heat treat to higher temperatures is useful in relieving internal stresses in the article produced, which improves the magnetic properties. Also, higher crystallization temperatures should extend the useful temperature range over which optimum magnetic properties are maintained for articles made therefrom.

It has been found that chromium leads to a pronounced improvement in castability. Although chromium is grouped with iron in FIG. 1, it is stressed that chromium has an important unique effect. Chromium content is critical to the amorphousness and magnetic properties of the Fe-B-Si alloys, such as that disclosed in co-pending U.S. patent application Ser. No. 382,824, filed May 27, 1982, by the common Assignee of the present invention, which application is incorporated herein by reference. Chromium content is critical for it has been found to greatly enhance the amorphousness while maintaining the magnetic properties of such Fe-B-Si alloys. Unexpectedly, it has been found that 0.1–4%, preferably 0.5 to 3.0%, chromium drastically improves the castability and thus the amorphousness of the alloy. Without intending to be limited to the reason for such improved castability, it appears that the chromium depresses the eutectic temperature of the Fe-B-Si alloys which tends to make the alloy easier to make amorphous and less brittle. It has also been found that the corrosion resistance of the Fe-B-Si alloys is improved by the addition of chromium. This is an advantage for transformer core materials, for the commonly-used Fe-Si wrought transformer core materials and Fe-B-Si amorphous alloys, such as those described in co-pending U.S. patent application Ser. No. 235,064 by the common Assignee of the present invention, are quite susceptible to damaging rust formation at ambient temperature and humidity conditions, particularly in storage and during fabrication. The following shows the improvements realized in the Cr-bearing alloys:

Corrosion of Amorphous Alloys in Air @ 99% Humidity

| Composition | % Area Rusted* |
|---|---|
| $Fe_{74.5}B_{8.5}Si_{17}Cr_0$ | 75.8 |
| $Fe_{74.5}B_{7.5}Si_{17}Cr_1$ | 25.8 |
| $Fe_{73}B_{7.5}Si_{17}Cr_{2.5}$ | None |

*Standard grid count determination of area rusted after 240 hours exposure at 25° C.

In the alloy of the present invention, certain incidental impurities, or residuals, may be present. Such incidental impurities together should not exceed 0.83 atomic percent of the alloy composition. The following is a tabulation of typical residuals which can be tolerated in the alloys of the present invention.

| Typical Residual Amounts (Atomic %) | Element |
|---|---|
| .0038 | Tin |
| .0045 | Aluminum |
| .0049 | Titanium |
| .017 | Molybdenum |
| .012 | Phosphorus |
| .029 | Nickel |
| .080 | Manganese |
| .022 | Copper |
| .0062 | Sodium |
| .0012 | Potassium |
| .0023 | Lead |
| .006 | Nitrogen |
| .020 | Oxygen |
| .13 | Carbon |
| .0032 | Sulfur |
| .00036 | Magnesium |
| .00049 | Calcium |
| .00058 | Zirconium |
| Less than .2 | Others |

Alloys of the present invention are capable of being cast amorphous from molten metal using spin or draw casting techniques. In order to more completely understand the present invention, the following example is presented:

EXAMPLE I

Various alloys were cast between 73–80% iron, 0 to 4% chromium, 6–10% boron and 14–17% silicon. Ductility, castability, amorphousness, magnetic properties, and thermal stability of the alloys lying on three constant silicon levels were determined.

Figure 2:
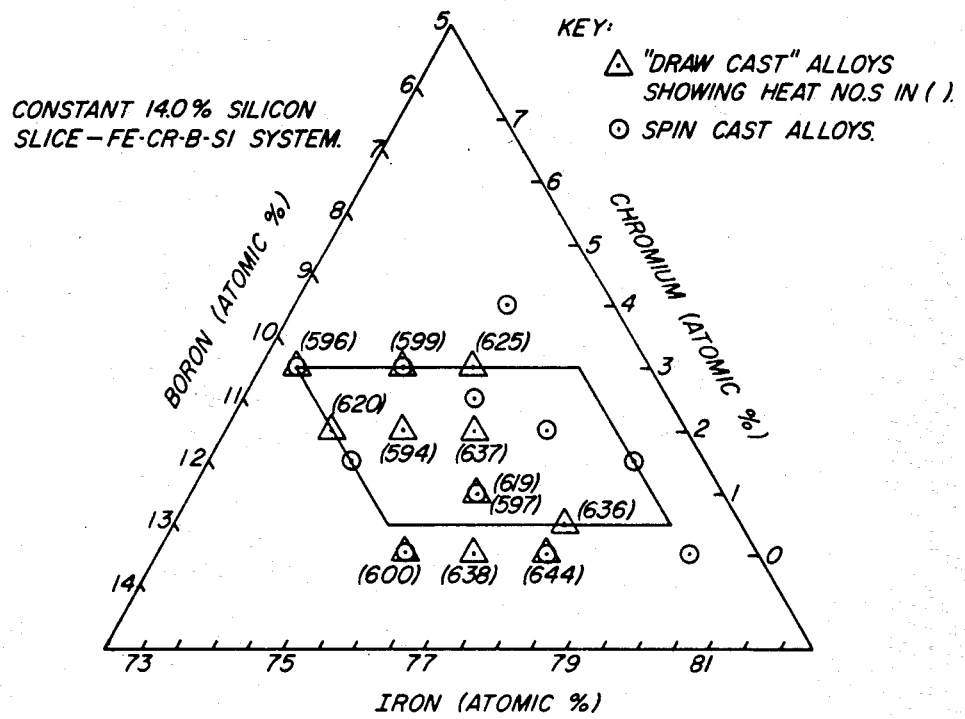
FIG. 2 is a constant 14% Si slice through the iron-boron-silicon-chromium quaternary alloy diagram of the present invention showing 0–4% Cr and 4 to 10% B.
Figure 3:
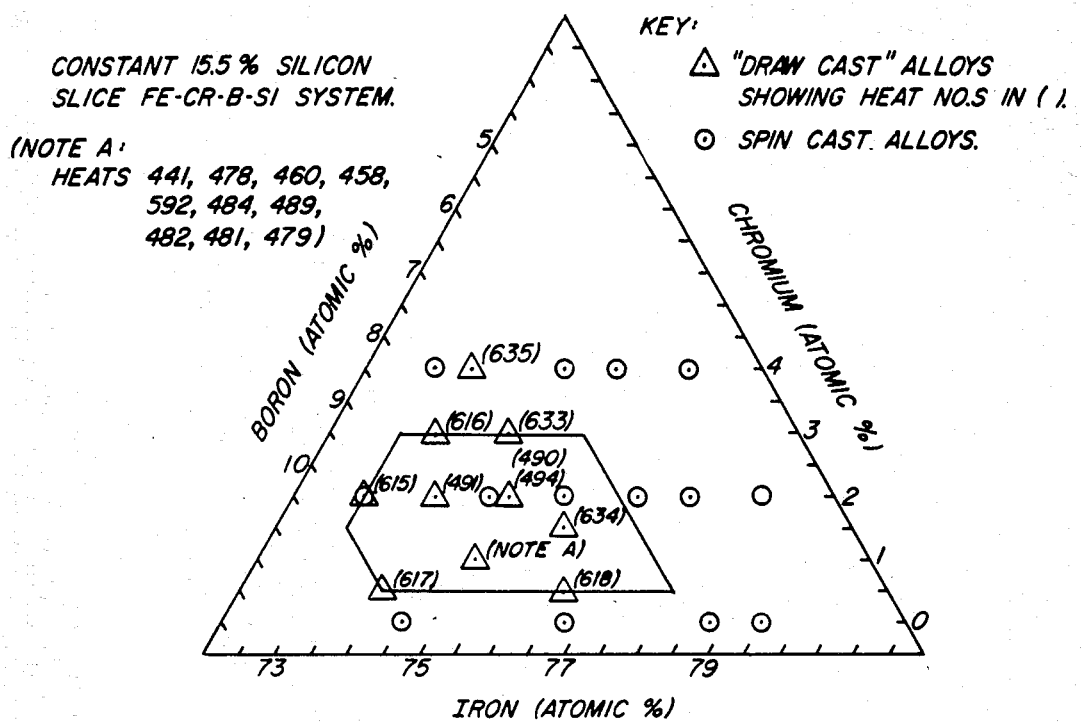
FIG. 3 is the same as FIG. 2, with a 15.5% Si content.
Figure 4:
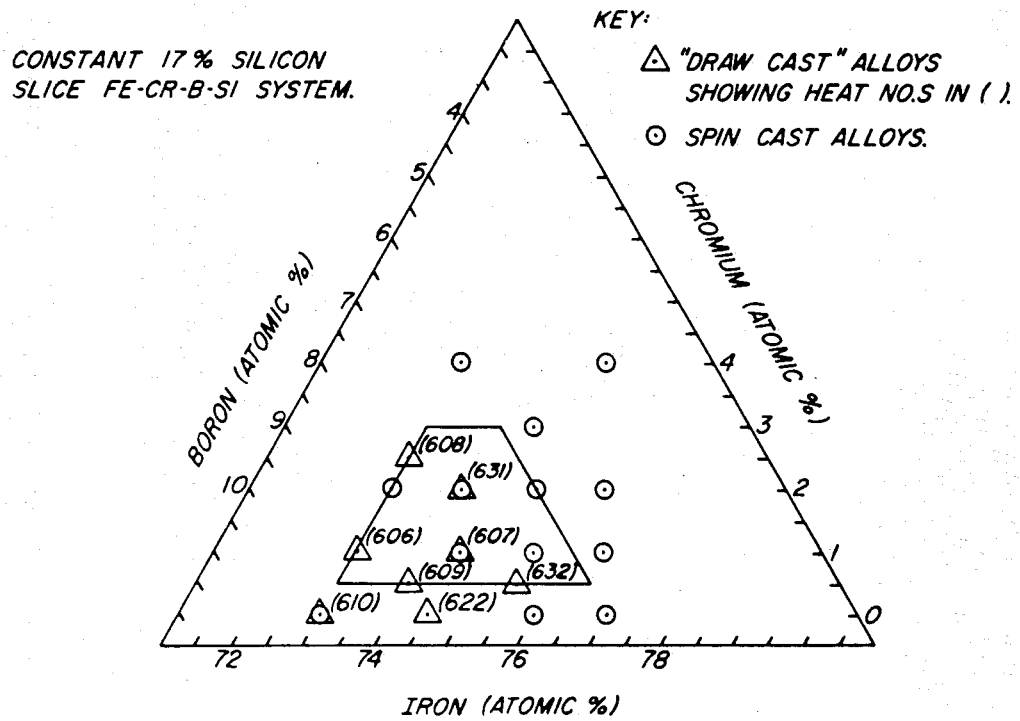
FIG. 4 is the same as FIG. 2, with a 17% Si content.

Alloys were cast at three levels of silicon using conventional spin casting techniques as are well known in the art. In addition, alloys were also "draw cast" (herein later explained) at widths of 1.0 inch (2.54 cm). For example, the alloys shown in the constant silicon slices of the quaternary iron-boron-silicon-chromium phase diagram, FIGS. 2–4, show preferred ranges of this invention. All the alloys cast in developing this invention, either by spin casting or by draw casting, are shown on FIGS. 2–4. The circles represent spin-cast heats and the triangles draw-cast heats. The draw casts are further identified by the appropriate heat numbers shown to the right of the triangle in parentheses. The solid lines drawn in the diagram represent a preferred range of our invention. While spin casting techniques indicate that certain alloys may tend to be amorphous, certain other casting techniques, such as draw casting of wider widths of material, may not be, for the quench rates are reduced to about $1\times10^{5}$° C. per second.

In general, the high boron-low iron alloys at each silicon level are amorphous and ductile, regardless of chromium content. At higher iron and lower boron levels, the ductility begins to deteriorate and as cast crystallinity begins to appear which coincidently make manufacture by draw casting techniques more difficult. With respect to alloy stability, the accepted measurement is the temperature at which crystallization occurs and is given the symbol $T_x$. It is often determined by Differential Scanning Calorimetry (DSC) whereby the sample is heated at a pre-determined rate and a temperature arrest indicates the onset of crystallization. In Table I are examples of various alloys all heated at 20° C./minute in the DSC. It is important that the heating rate is stipulated for the rate will affect the measured temperature.

TABLE I

| Differential Scanning Calorimetry Crystallization Temperatures | | |
|---|---|---|
| Alloy Composition (Atomic %) | Crystallization Temp. (°C.) | Comment |
| $Fe_{80}B_{10}Si_{10}$ | 502 | Low silicon, high boron alloys |
| $Fe_{81}B_{13}Si_6$ | 505 | |
| $Fe_{79}B_{15}Si_6$ | 528 | |
| $Fe_{78.5}B_{6.1}Si_{14}Cr_{1.4}$ | 539 | Low boron, high silicon, with chromium alloys of present invention |
| $Fe_{76.5}B_{8.5}Si_{14}Cr_1$ | 534 | |
| $Fe_{73}B_{9.5}Si_{15.5}Cr_2$ | 527 | |
| $Fe_{76.25}B_{7.25}Si_{15.5}Cr_1$ | 530 | |
| $Fe_{73}B_6Si_{17}Cr_4$ | 538 | |
| $Fe_{73}B_{7.5}Si_{15.5}Cr_4$ | 545 | |

As shown in the table, lower boron levels and lower iron levels permitting higher silicon content will promote a higher crystallization temperature ($T_x$) with examples as high as 1013° F. (545° C.).

Bend tests conducted on the "spin-cast" and "draw-cast" alloys determined that the alloys were at least singularly ductile. The bend tests include bending the fiber or strip transversely upon itself in a 180° bend in either direction to determine the brittleness. If the strip can be bent upon itself along a bend line extending across the strip (i.e., perpendicular to the casting direction) into a non-recoverable permanent bend without fracturing, then the strip exhibits ductility. The strip is double ductile if it can be bent 180° in both directions without fracture, and single or singularly ductile if it bends 180° only in one direction without fracture. Singular ductility is a minimum requirement for an article made of the alloy of the present invention. Double ductility is an optimum condition for an article made of the alloy of the present invention.

Various known methods of rapid solidification may be used for casting the amorphous metal alloy of the present invention. Particularly, the alloy may be cast using draw casting techniques. Typically, a draw casting technique may include continuously delivering a molten stream or pool of metal through a slotted nozzle located within less than 0.025 inch (0.035 cm) of a casting surface which may be moving at a rate of about 200 to 10,000 linear surface feet per minute (61 to 3048 m/minute) past the nozzle to produce an amorphous strip material. The casting surface is typically the outer peripheral surface of a water-cooled metal wheel, made, for example, of copper. Rapid movement of the casting surface draws a continuous thin layer of the metal from the pool or puddle. This layer rapidly solidifiest at a quench rate on the order of $1\times10^{5}$° C. per second into strip material. Typically, alloys of the present invention are cast at a temperature above about 2400° F. (1315° C.) onto a casting surface having an initial temperature that may range from about 35° to 90° F. (1.6° to 32° C.). The strip is quenched to below solidification temperature and to below the crystallization temperature and after being solidified on the casting surface it is separated therefrom. Typically, such strip may have a width of 1 inch (2.54 cm) or more and a thickness of less than 0.003 inch (0.00762 cm), and a ratio of width-to-thickness of at least 10:1 and preferably at least 250:1.

In order to test the magnetic properties of the alloys of the present invention, various alloys were cast into thin strip materials using the draw casting technique. Some examples of alloys so-cast taken from examples shown in FIGS. 2–4, being both substantially amorphous and double ductile, are shown in the following Tables II and III.

TABLE II

| Heat No. | Composition Atomic Percent Iron | Chromium | Boron | Silicon |
|---|---|---|---|---|
| 607 | 74.5 | 1 | 7.5 | 17 |
| 608 | 73 | 2.5 | 7.5 | 17 |
| 610 | 73 | 0 | 10 | 17 |
| 460 | 75 | 1 | 8.5 | 15.5 |
| 615 | 73 | 2 | 9.5 | 15.5 |
| 616 | 73.5 | 3 | 8 | 15.5 |
| 617 | 74 | 0.5 | 10 | 15.5 |
| 618 | 76.5 | 0.5 | 7.5 | 15.5 |
| 600 | 76 | 0 | 10 | 14 |
| 619 | 76.5 | 1 | 8.5 | 14 |
| 620 | 74 | 2 | 10 | 14 |

TABLE III

| | | HEAT NO. | | | | |
|---|---|---|---|---|---|---|
| | 6 mil | 17 Atomic % Si | | | 15.5 Atomic % Si | |
| ALLOY COMPOSITION THICKNESS | AL 4750 Ni—Fe Alloy (Reference) | ALR607 $Fe_{74.5}Cr_1B_{7.5}Si_{17}$ 1.0 | ALR608 $Fe_{73}Cr_{2.5}B_{7.5}Si_{17}$ 1.2 | ALR610 $Fe_{73}B_{10}Si_{17}$ 1.1 | ALR618 $Fe_{76.5}Cr_{0.5}Br_{7.5}Si_{15.5}$ 1.2 | ALR460 $Fe_{75}Cr_1B_{8.5}Si_{15.5}$ 1.2 |
| MAGNETIC PROPERTIES | | | | | | |
| D.C. B @ 1H | 12600 | 11500 | 10000 | 13300 | 12600 | 12600 |
| Br | 9200 | 8300 | 5400 | 11100 | 9400 | 9200 |
| Hc | .0361 | .0375 | .0365 | .0301 | .0417 | .0364 |
| B @ 10H | 15000 | 13800 | 12300 | 14500 | 14700 | 14100 |
| B @ 75H | 15500 | 14400 | 13100 | 15000 | 15100 | 14600 |
| 60 $H_z$ WPP @ 1.0T | .10 | .0805 | .0551 | .0422 | .0647 | .0517 |
| 1.1T | .12 | .0970 | .0646 | .0541 | .0791 | — |
| 1.2T | .145 | .116 | .0829 | .0697 | .0936 | .0735 |
| 1.26T | .163 | .129 | .0948 | .0771 | .102 | .0802 |
| 1.3T | .175 | .137 | .178 | .0821 | .109 | — |
| 1.4T | .21 | .165 | — | .0954 | .126 | .0983 |
| 1.5T | — | — | — | .183 | .158 | — |
| 60 $H_z$ VAPP @ 1.0T | .15 | .189 | .611 | .0446 | .0988 | .0875 |
| 1.1T | .25 | .415 | 1.30 | .0644 | .196 | — |
| 1.2T | .60 | .929 | 3.46 | .144 | .416 | .443 |
| 1.26T | 1.14 | 1.51 | 11.33 | .288 | .660 | .765 |
| 1.3T | 1.50 | 2.13 | 54.18 | .466 | .906 | — |
| 1.4T | 4.0 | 8.59 | — | 1.83 | 2.10 | 4.73 |
| 1.5T | — | — | — | 57.4 | 26.5 | |

| | HEAT NO. | | | | | |
|---|---|---|---|---|---|---|
| | 15.5 Atomic % Si | | | 14.0 Atomic % Si | | |
| ALLOY COMPOSITION THICKNESS | ALR617 $Fe_{74}Cr_{0.5}B_{10}Si_{15.5}$ 1.1 | ALR615 $Fe_{73}Cr_2B_{9.5}Si_{15.5}$ 1.0 | ALR616 $Fe_{73.5}Cr_3B_8Si_{15.5}$ 1.2 | ALR600 $Fe_{76}B_{10}Si_{14}$ 1.1 | ALR619 $Fe_{76.5}Cr_1B_{8.5}Si_{14}$ 1.2 | ALR620 $Fe_{74}Cr_2B_{10}Si_{14}$ 1.0 |
| MAGNETIC PROPERTIES | | | | | | |
| D.C. B @ 1H | 12000 | 10500 | 10700 | 13200 | 12800 | 10000 |
| Br | 8600 | 6100 | 6700 | 10600 | 11000 | 5400 |
| Hc | .0367 | .0357 | .0285 | .0392 | .0245 | .0391 |
| B @ 10H | 14300 | 13300 | 13000 | 14900 | 14600 | 12400 |
| B @ 75H | 14800 | 13900 | 13400 | 15400 | 14900 | 13500 |
| 60 $H_z$ WPP @ 1.0T | .0553 | .0566 | .0497 | .0565 | .0450 | .0509 |
| 1.1T | .0653 | .0661 | .0577 | .0725 | .0616 | .0593 |
| 1.2T | .0766 | .0774 | .0679 | .0863 | .0760 | .0728 |
| 1.26T | .0842 | .0944 | .0799 | .0934 | .0820 | .0832 |
| 1.3T | .0899 | .0991 | .0843 | .0992 | .0867 | .0884 |
| 1.4T | .109 | — | — | .115 | .102 | — |
| 1.5T | — | — | — | .142 | .170 | — |
| 60 $H_z$ VAPP @ 1.0T | .139 | .474 | .382 | .0659 | .0488 | .617 |
| 1.1T | .310 | .932 | .796 | .104 | .0774 | 1.32 |
| 1.2T | .684 | 1.87 | 1.68 | .237 | .229 | 3.69 |
| 1.26T | 1.10 | 2.94 | 2.87 | .428 | .473 | 8.85 |
| 1.3T | 1.55 | 4.27 | 5.90 | .623 | .734 | 19.06 |
| 1.4T | 4.05 | — | — | 1.64 | 2.07 | — |
| 1.5T | — | — | — | 9.60 | 60.3 | — |

The data of Table III demonstrates that the core loss, which should be as low as possible, is less than 0.163 watts per pound at 60 Hertz, at 12.6 kilogauss (1.26 tesla), typical of Ni-Fe alloy AL 4750. More preferably, such core loss value should be below 0.100 watts per pound and most of the alloys shown in Table II are below that value. Furthermore, the magnetic saturation, measured at 75 oersteds ($B_{75H}$) which should be as high as possible, is shown to be in excess of 14,000 G. The alloys were found to be amorphous and easily cast into a ductile strip material. Furthermore, the strip was thermally stable and permitted stress relieving to optimize magnetic properties.

The results of such tests showed that chromium additions of up to 3 atomic percent improve the amorphousness and ductility of the alloy. Unexpectedly, there was an improvement in castability. The molten puddle appeared less turbulent and the strip was less erratic in self-ejection from the wheel at heavy and light gauge. Furthermore, dwell time of the solidified strip on the casting wheel appeared to be increased, and the strip thickness produced more readily adjustable by changing the standoff distance of the nozzle from the casting surface. In addition, the surface quality of the strip appeared much improved on the side of the strip which had contacted the casting wheel surface. The addition of chromium causes remarkable and beneficial changes in the conditions, both thermal and mechanical, at the interface between the molten metal and the casting surface.

Figure 5:
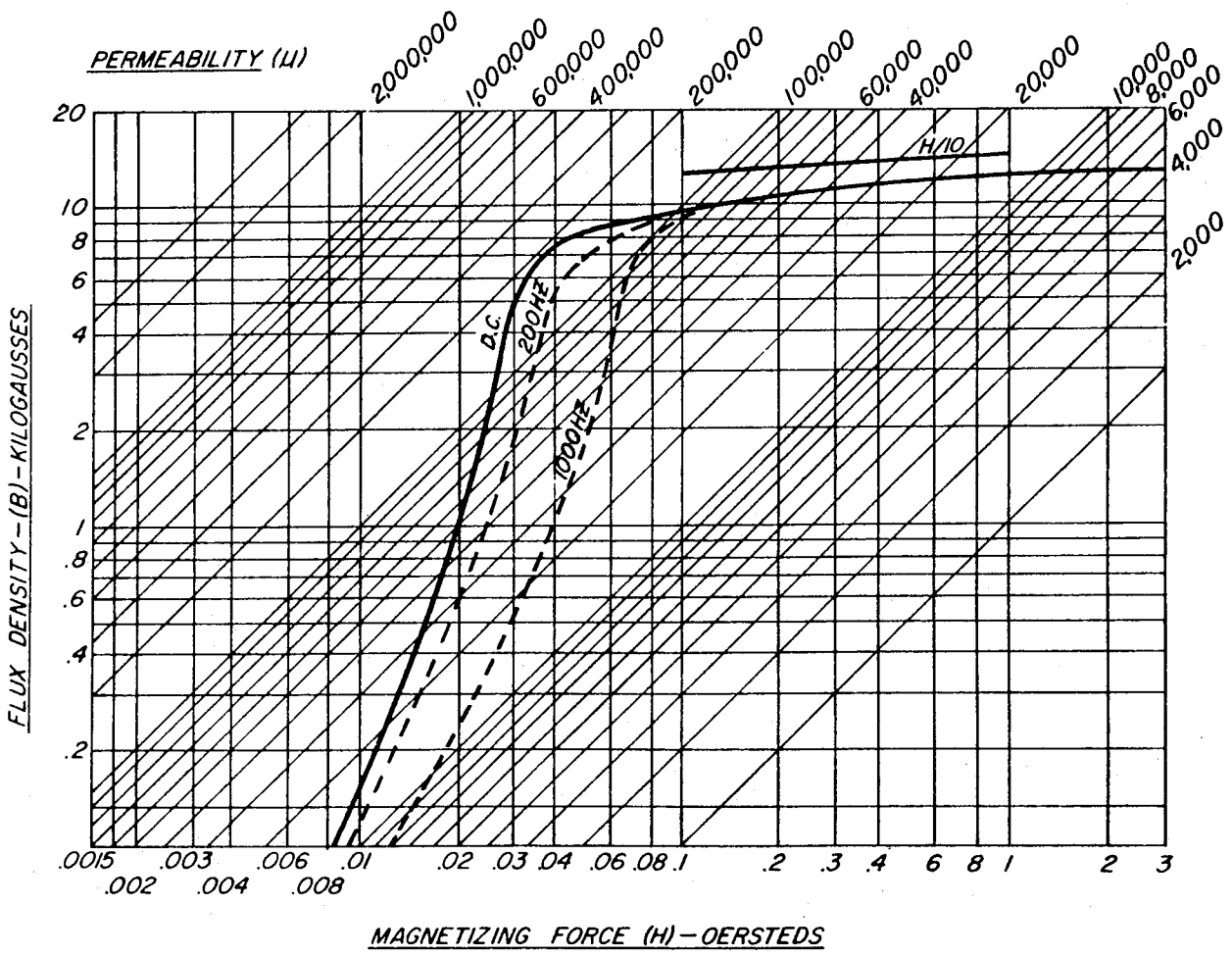
FIG. 5 is a graph of induction and permeability versus magnetizing force for the alloy of the present invention.
Figure 6:
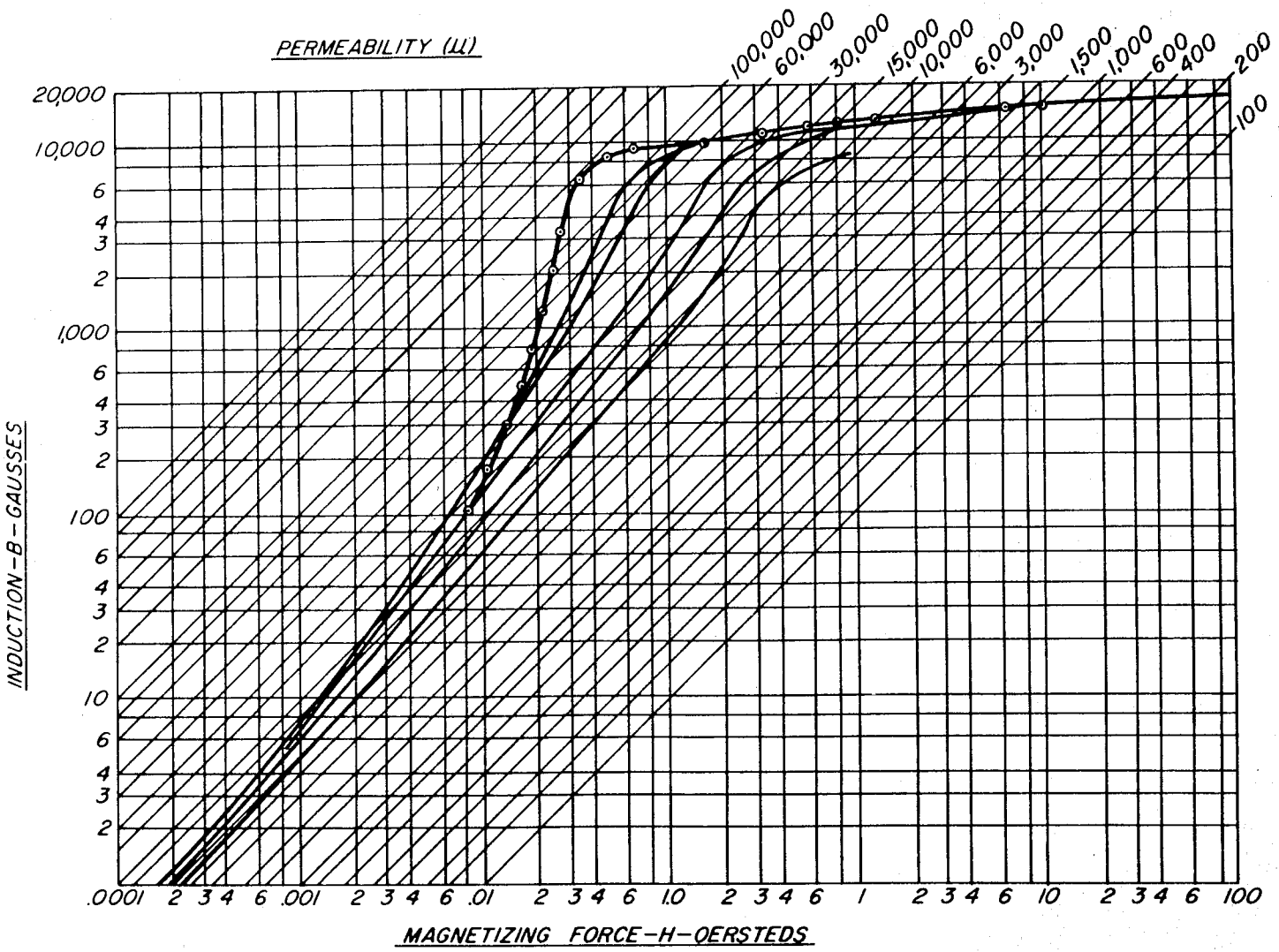
FIG. 6 is a graph of induction and permeability versus magnetizing force comparing a commercial alloy to the alloy of the present invention.
Figure 7:
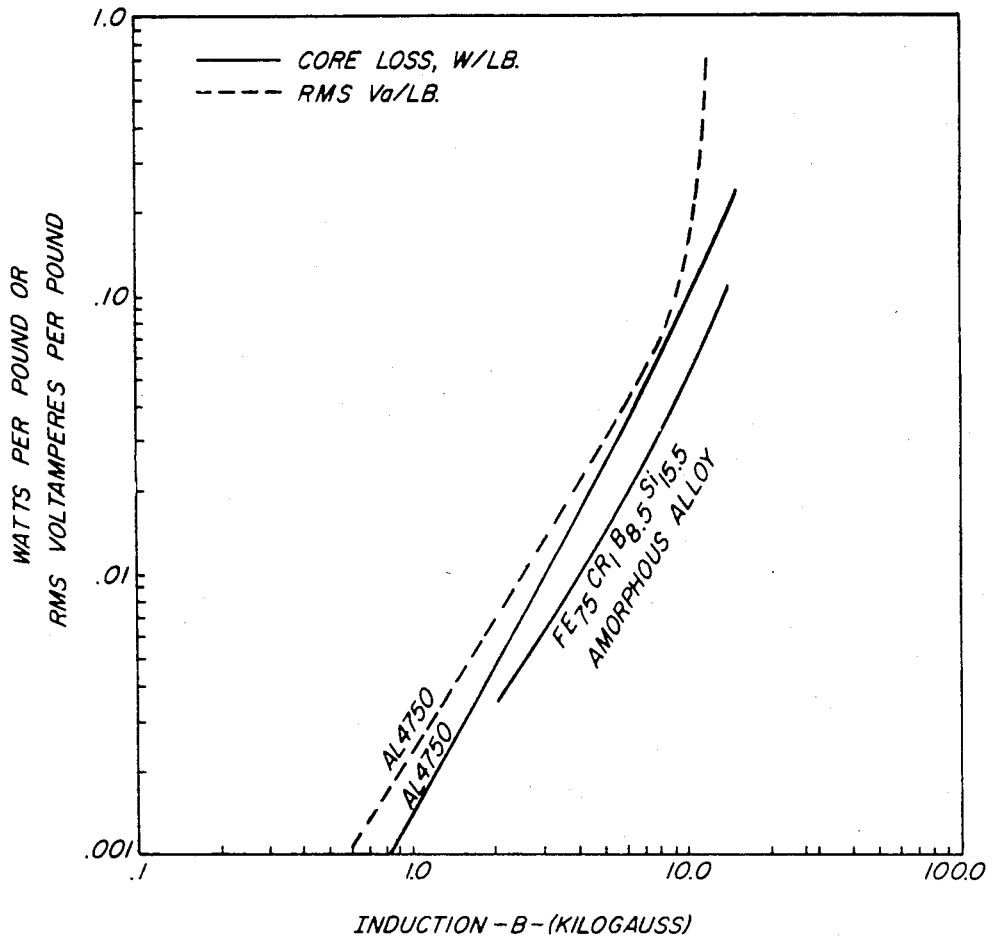
FIG. 7 is a graph of core loss and apparent core loss versus induction at 60 Hertz comparing a commercial alloy with the alloy of the present invention.

As an example of the excellent quality which can be obtained, magnetic properties of one of the alloys from Table II, Heat No. 460, $Fe_{75}Cr_1B_{8.5}Si_{15.5}$, are compared to commercial alloy AL 4750 as shown in FIGS. 5-7. AL 4750 alloy nominally consists essentially of 48% nickel and 52% iron.

FIG. 5 is a graph of magnetization, permeability and saturation curves for the chromium-bearing $Fe_{75}Cr_1B_{8.5}Si_{15.5}$ alloy of the present invention at DC and higher frequencies.

The present alloy with chromium additions has been shown to have DC induction properties superior to AL 4750 at above 300 Gauss. As better shown in FIG. 6, the slightly squarer properties result in a higher DC permeability. FIG. 6 is a graph of magnetization, permeability and saturation curves for the same chromium-bearing alloy of the present invention at DC magnetizing force in comparison with AL 4750 alloys at DC and higher frequencies. At inductions lower than 300 Gauss, the properties are still within the range of the AL 4750 alloy, although for 60 Hertz service the permeability at 4 Gauss is only 7500, which is lower than normally required of AL 4750 alloys.

FIG. 7 is a graph of core loss and apparent core loss versus induction for AL 4750 alloy and the same chromium-bearing alloy of the present invention. Core losses of the alloy compare very favorably and are nominally one-half that of AL 4750, a very important feature, especially for transformer core applications.

Further tests were done on Fe-B-Si alloys containing chromium for alloys disclosed in pending U.S. patent application Ser. No. 235,064, filed Feb. 17, 1981 by the common Assignee of the present invention. Those alloys generally contain 77-80% iron, 12-16% boron and 5-10% silicon. Particularly, two compositions, $Fe_{79}B_{14.5}Cr_{0.5}Si_6$ and $Fe_{81}B_{12.5}Cr_{0.5}Si_6$, were draw cast in the same manner as were the other alloys mentioned herein. Chromium also improved the castability of these alloys. The molten puddle, stripping from the casting wheel surface and surface quality of the strip were improved as desired with regard to alloys of the present invention.

Magnetic properties of the alloys set forth in Table IV show good core loss and hysteris loop squareness with a minor loss in magnetic saturation when compared to similar alloys without chromium.

TABLE IV

| | Heat 569 $Fe_{79}B_{14.5}Cr_{.5}Si_6$ | Heat 589 $Fe_{79}B_{15}Si_6$ | Heat 488 $Fe_{81}B_{12.5}Cr_{.5}Si_6$ | Heat 487 $Fe_{81}B_{13}Si_6$ |
|---|---|---|---|---|
| D.C. B @ 1H | 14330 | 15100 | 14900 | 14000 |
| Br | 12500 | 13900 | 14000 | 12200 |
| $H_c$ | .0263 | .0275 | .0285 | .0377 |
| D.C. B @ 10H | 15400 | 15700 | 15400 | 14900 |
| B @ 75H | 15900 | 16200 | 15800 | 15800 |
| A.C. WPP @ 1.0T | .0411 | .0512 | .0481 | .0494 |
| 1.26T | .0718 | .0751 | .0719 | .0779 |
| 1.4T | .100 | .104 | .101 | .112 |
| A.C. VAPP @ 1.0T | .0421 | .0528 | .0499 | .0580 |
| 1.26T | .0848 | .0800 | .0759 | .109 |
| 1.4T | .208 | .121 | .121 | .674 |

The results have shown that controlled chromium levels in amorphous Fe-B-Si alloys enhance castability of the alloys while maintaining good magnetic properties, and provide alloys having high crystallization temperatures compared to lower Si alloys which are substantially free of Cr, i.e., less than 0.1 atomic percent.

The present invention provides alloys useful for electrical applications and articles made from those alloys having good magnetic properties. The chromium-containing alloys of the present invention can be made less expensively because they use lower amounts of costly boron. Furthermore, the alloys are amorphous, ductile and have a thermal stability greater than those iron-boron-silicon alloys having more than 10% B and less than 15% Si. Furthermore, additions of chromium to Fe-B-Si alloys are critical to improve the castability of the alloys, as well as enhancing the amorphousness and maintaining good magnetic properties.

While several embodiments of the invention have been shown and described, it will be apparent to those skilled in the art that modifications may be made therein without departing from the scope of the invention.

What is claimed is:

1. A method of casting an amorphous strip material having a width of at least one inch, a thickness of at least 0.001 inch, a 60 Hertz core loss of less than 0.163 watts per pound at 12.6 kilogauss, saturation magnetization ($B_{75H}$) of at least 14 kilogauss, a coercive force of less than 0.045 oersteds and is at least singularly ductile, comprising the steps of:

melting an alloy consisting essentially of 6-10% boron and 14-17% silicon, 0.5-3.0% chromium, by atomic percentages, with no more than incidental impurities, and the balance iron;

while maintaining the alloy molten, continuously delivering a stream of molten alloy through a slotted nozzle and onto a casting surface disposed within 0.025 inch of the nozzle;

continuously moving the casting surface past the nozzle at a speed of 200 to 10,000 linear surface feet per minute;

at least partially solidifying the strip on the casting surface; and separating the at least partially solidified strip from the casting surface.

2. The method as set forth in claim 1 wherein said alloy consists essentially of 6 up to less than 10% boron, from more than 15% up to 17% silicon and 0.5 to 3.0% chromium, by atomic percentages, with no more than incidental impurities and the balance iron.

* * * * *